United States Patent [19]

Burch

[11] 4,416,692

[45] Nov. 22, 1983

[54] PROCESS FOR EXTRACTING GOLD, SILVER, PLATINUM, LEAD, OR MANGANESE METALS FROM ORE

[76] Inventor: Glen R. Burch, 825 Ticonderoga Dr., Sunnyvale, Calif. 94087

[21] Appl. No.: 236,997

[22] Filed: Feb. 23, 1981

[51] Int. Cl.[3] ..... C22B 11/12

[52] U.S. Cl. ..... 75/63; 75/10 R; 75/77; 75/80; 75/83

[58] Field of Search ..... 75/83, 77, 63, 65, 62, 75/80, 10 R; 266/176, 177, 205

[56] References Cited

U.S. PATENT DOCUMENTS 2,238,792 4/1941 Hanawalt et al. ..... 266/176
3,094,411 6/1963 Triffleman ..... 75/65 R

FOREIGN PATENT DOCUMENTS 282543 12/1927 United Kingdom ..... 75/83

*Primary Examiner*—M. J. Andrews
*Attorney, Agent, or Firm*—Thomas E. Schatzel

[57] ABSTRACT

A process for extracting metals having lead affinity from mineral ores. The process is in steps including, pulverizing the ore material, drying the ore, melting elemental lead in a melting chamber and maintaining the molten lead within a preselected temperature range, introducing the ore into the lower portion of the melting chamber, agitating the molten mixture, transferring the molten mixture to a cooling vessel, removing the slag and refining the remaining metallic mixture to separate the metallic components. Also, a device for extracting metals from ores including a melting chamber, heating means, an ore tube and an auger for inserting ore into the melting chamber and an agitation rod. The process and device are utilized for either small scale assaying of ore samples or commercial extraction of metals from mineral ores.

16 Claims, 3 Drawing Figures

PROCESS FOR EXTRACTING GOLD, SILVER, PLATINUM, LEAD, OR MANGANESE METALS FROM ORE

BACKGROUND OF THE INVENTION

1. Field of the Invention

The present invention relates generally to materials processing and more specifically to processes and apparati for extracting various metals from mineral ores.

2. Description of the Prior Art

The arts of metallurgy and metal working pre-date written history. Extraction, melting, and fabrication of items in bronze and iron has been an essential part of human civilization for several thousand years. The precious metals gold and silver have been known for thousands of years and have long provided bases for currency and materials for construction of decorative and useful items.

Recently, the precious metals, particularly gold, silver, and platinum, have achieved greatly increased value. These metals have increased in value not only due to their decorative value and scarcity but also due to the fact that they are of extreme use in medical processes and in the fabrication of electronic components. With the drastic increase of the value of these precious metals has come a concurrent increase in the interest in obtaining these metals from the environment.

Processes and devices for extracting precious metals, particularly gold and silver, from mineral ores have been known for thousands of years. Nearly all of these processes have involved the application of high amounts of heat to the ores such that the precious metals would melt and flow from the ores. In many cases, various chemicals or materials were added to the ores prior to heating.

One extraction method which has been known since the beginning of written history is the use of metallic lead (Pb) as an extraction material. Metallic lead has a particular affinity for various metals including, gold, silver, platinum, manganese, and lead itself. It was recognized early that the use of elemental lead could aid in the extraction of these metals from their ores. However, very little attention has been paid to the particular procedure for maximizing the extraction or to the devices to be utilized for such extraction. The use of metallic lead as a precious metal extracter through the centuries has consistently been crude and has resulted in relatively low yields. High yield process modifications have not been forthcoming.

Lead extraction processes have been rarely utilized in the metal processing industry in modern times. Modern extraction methods are designed for high volume flow processes to which lead extraction technology has not yet been effectively adapted. These industrial processes are usually not readily adaptable for use in low volume processes such as assaying.

SUMMARY OF THE INVENTION

Accordingly, it is an object of the present invention to provide a process and apparatus for extracting various metals from mineral ores by utilizing molten elemental lead to extract an extremely high yield of the precious metals contained therein.

It is another object of the present invention to provide a process and apparatus for extracting smaller diameter particles of the precious metals from the ore than may be achieved with prior art processes and apparati.

Briefly, a preferred embodiment of the present invention relates to a process for extracting those metals having lead affinity from mineral ore. The process includes various steps. An initial step involves pulverizing and thoroughly drying the ore material. Elemental lead is then melted in a chamber and the molten lead is maintained within a temperature range of approximately 650° C. to 820° C. (approximately 1200° F. to 1500° F.). The dried pulverized ore is then introduced into the molten elemental lead from the lower portion of the chamber and agitated, both rotationally and translationally, within the molten lead for approximately fifteen minutes. The resultant molten mixture is then removed from the melting chamber onto a cooling vessel, the slag is removed from the top, and the resulting metal-impregnated lead is then refined through any of a number of processes to extract the individual precious metals.

The process may utilize various devices for the extraction procedure. One preferred embodiment of an apparatus of the present invention for extracting metals from ore includes an inner melting chamber surrounded by a heating mechanism, an auger means for delivering dried pulverized ore to the bottom of the melting chamber, and an agitation rod for providing the agitation to the molten mixture.

It is an advantage of the present invention that the process and apparatus may be easily reduced to a small scale operation performed in the ore field.

It is another advantage of the present invention that the process is easily accomplished and economical.

It is yet another advantage that the elemental lead utilized for extracting the remaining metals may be recovered and reused.

It is a further advantage that the precious metal yield, particularly regarding very fine particulate metals, is higher than with prior processes and apparati.

These and other objects and advantages of the present invention will become clear to one skilled in the art upon reading the following detailed description of the preferred embodiment and upon studying the several figures of the drawing.

IN THE DRAWING

DETAILED DESCRIPTION OF THE PREFERRED EMBODIMENT

Figure 1:
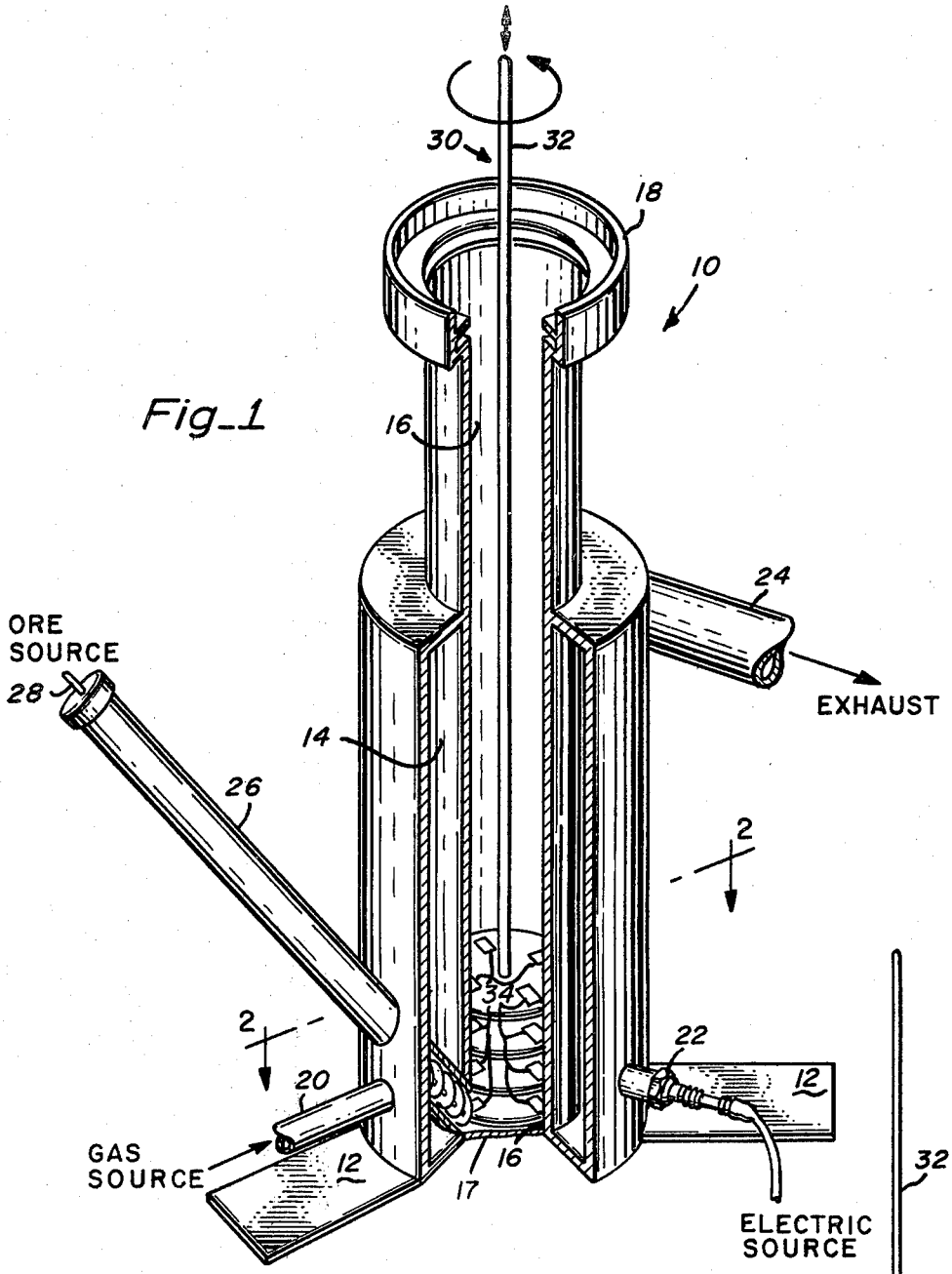
FIG. 1 is a perspective view of an extractor apparatus for use with the process of the present invention.

The present invention is a process for extracting various metals from mineral ores and also to apparatus for carrying out such process. The process is directed to those metals which show an affinity to elemental lead, and particularly to gold, silver, and platinum. The process is adapted for use with various apparati and may be utilized either on a small scale in the laboratory or ore field for the purposes of assaying the ore or on a larger scale for commercial processing of metallic ores.

A first step utilized in the process is taking the ore material provided (and containing the metals to be extracted) and pulverizing the ore to very fine particles. It is generally true that the finer the granulation of the particles, the higher the precious metal yield will be from the process. However, this is not a linear relationship, and a point of diminishing returns of metals compared to the cost of further pulverizing is reached. A preferred particle size for the pulverized ore material has been found to be approximately 325 mesh (the material fits through a mesh having 325 interstices per inch). It is preferred that the particle size not exceed 250 mesh. Various mechanical crushers and grinders are appropriate for performing this step.

A second step in the process involves thoroughly drying the pulverized ore particles. Since the particles are to be introduced to the lower part of a volume of molten lead, any water or other liquids which are contained in the ore would be immediately vaporized by the high temperature. The subsequent expansion of the liquids into gases could well cause dangerous upheavals in the molten mixture and otherwise generally impair the effectiveness of the procedure. Any drying method which effectively eliminates the free moisture content of the ore is sufficient. In the preferred embodiment, sun drying and oven drying are the most frequently used.

The precise order of the pulverizing and drying steps is not a critical factor. For certain high-moisture-content ore materials it may be necessary to dry the material first to facilitate the pulverization. However, it is important that the ore material not be allowed to absorb further moisture from the environment subsequent to the drying step. Thus, as long as the pulverization immediately follows drying and introduction into the chamber immediately follows pulverization, the initial steps may be reversed in order.

The third step of the process involves melting, in a suitable chamber, a quantity of elemental lead. The lead is then maintained within a preselected temperature range. For the preferred embodiment of the process, the chamber utilized for melting should have a vertical dimension exceeding its horizontal dimensions. This shape of construction is valuable since the metal extraction occurs as the ore gradually works from the bottom of the molten lead to the top. Therefore, the greater the depth of the lead, the greater the opportunity for the extraction of metals. For most effective agitation, chambers without corner areas, such as cylinders, are preferrable.

The particular amount of lead selected depends upon the container and the intended ore volume. It is not necessary that the initial lead be particularly pure. Experimentation has shown that the molten lead can absorb up to approximately sixty percent of its own weight in other metals before reaching a point of relative saturation. However, since it appears that the rate of extraction is at least partially dependent on the prior saturation of the elemental lead, it is preferable for the initial lead to be as nearly pure as possible.

Elemental lead is utilized both for its affinity to the precious metals, particularly gold, silver and platinum, and also for its high density. The very high density of elemental lead causes the impurities and slag found in the ore to float to the top of the molten lead where it is most easily skimmed off and removed.

The temperature range selected must be sufficiently high to keep the lead in a molten state, even considering the addition of a significant amount of the cooler ore material, and low enough that various impurity-creating reactions do not occur. Furthermore, it is desirable to keep the temperature relatively low to conserve energy and reduce costs. The preferred temperature range has been found to be between approximately 650° C. (1200° F.) and 820° C. (1500° F.) with the empirically obtained optimum temperature being approximately 680° C. (1250° F.).

The fourth step involved is introducing the pulverized drying ore into the molten lead. Preferrably, the ore is introduced into the molten lead at points near the bottom of the melting chamber. Since the molten lead is of higher density than the ore which is introduced, the ore should be introduced at the bottom such that it is exposed to the maximum amount of molten lead while it is within the container. The ore will gradually float to the top and the precious metals will be extracted from the ore by direct contact with the molten lead during this gradual journey.

The ore may be introduced to the bottom of the melting container by use of an auger, plunger or similar insertion mechanism. A preferred embodiment employs an auger mechanism to feed ore into the melting chamber at a relatively constant rate. It is important to carefully design and operate an auger-type insertion mechanism to prevent the molten materials from backing up into the ore delivery channel. The insertion mechanism is designed to further prevent the molten lead from exiting the chamber into the ore storage areas. Other insertion mechanisms, such as plungers or piston mechanisms, may also be utilized.

The fifth step involved in the present process is agitating the entire molten mixture for a significant period of time while the ore remains in contact with the elemental lead. The agitation utilized should be both translational and rotational agitation. The object of the agitation is to provide a large amount of mixing of the ore particles within the molten lead. In this manner, a large amount of surface area of ore is exposed to the molten lead, and, consequently, a large amount of metal is extracted.

The amount of time allotted for continuing the agitation is dependent upon the size of container, the volume of lead, the volume of ore to be introduced, and the particular size and shape of the agitation means. The agitation should be maintained throughout the introduction of the ore to the chamber and for a period thereafter to allow for mixing during the entire period that the ore material is gradually rising to the top. In practice, for an approximately equal amount of lead and ore and with a typical agitation rod, an agitation period of approximately fifteen minutes has been found to be adequate.

The sixth step of the procedure involves pouring the molten mixture from the melting chamber to a cooling vessel. This removal allows the slag or waste products to float to the top of the molten lead and be easily skimmed off and removed.

The seventh step involves physically removing the slag from the top of the mixture. The slag is a by-product of the process made up of the remainder of the ore material which has not been extracted by the process. Slag is typically comprised predominantly of silicon oxides. Various metals not having an affinity to lead may also appear in this slag. A small amount of lead and precious metals will ordinarily be trapped in the slag, but this amount is usually not significant.

If the melting chamber is suitably designed, it may be possible to interchange the transferring and removing steps. The separation of the molten mixture into the predominantly lead portion and the slag portion will be completed soon after the agitation is stopped. If the upper portion of the melting chamber is sufficiently accessible, the slag may be skimmed off while the lead remains in its molten state. Such a procedure may be helpful in permitting the processing of a larger volume of ore per volume of lead utilized. The removal of slag at earlier stages will allow a greater use of the total volume of the melting chamber.

The final step of the extraction process is the refining of the resultant metallic mixture. The precious metals sought to be extracted from the ore are, at this point, amalgamated with the lead. Standard modern refining techniques will separate the various individual metals therefrom. The lead itself is recoverable from these refining operations such that a significant portion, ordinarily 80 to 95 percent, may be returned and reused in the process.

The above process is described in a batch process manner. However, it is possible to suitably modify the process and the devices to be utilized with the process such that it may become a plug or flow process.

If the process is to be used to assay a given ore sample, certain additional precautions must be taken. Initially, after the lead has been introduced into the melting chamber and melted, a sample of the molten lead should be removed for the initial or "control" assay sample. Next, a precise known quantity of the ore material to be tested is introduced into the melting chamber. In a typical application, the quantity introduced is 29.167 grams. This quantity is known as an "assay ton". Care should be taken that all of the ore is delivered into the melting chamber and that complete agitation takes place during an assay attempt. The refinement of the resulting lead mixture and the control sample will then determine the amount of various precious metals in the given quantity of the ore introduced.

Figure 2:
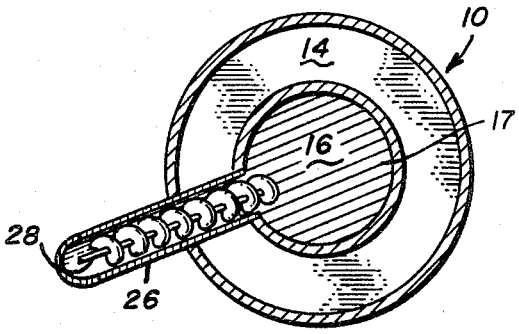
FIG. 2 is a cross-sectional view taken along lines 2—2 of FIG. 1.
Figure 3:
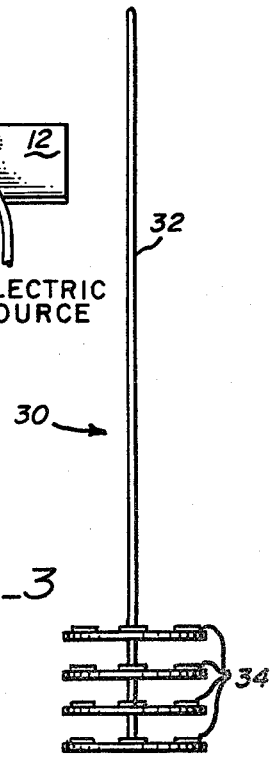
FIG. 3 is a plan view of an agitation rod for use with the extractor apparatus of FIG. 1.

A device for extracting metals from mineral ores in accordance with the present process is illustrated in FIGS. 1-3. FIG. 1 is a perspective view of a precious metal extractor apparatus, designated by the general reference character 10. Extractor 10 is designed for the purpose of extracting precious metals from mineral ores utilizing molten metallic lead as an extraction solvent.

Extractor 10 is supported by base supports 12 which extend outward to balance the substantially vertical extractor 10. In the embodiment shown, the number of base supports 12 is three, aligned at the points of an equilateral triangle so as to provide steady and equal support. Mounted upon the base supports 12 is a heating cylinder 14. Situated concentrically within the heating cylinder 14 is a cylindrically shaped melting chamber 16, which also extends above heating cylinder 14. The melting chamber 16 includes a bottom 17 and the top of melting chamber 16 includes a rim 18 which functions as a funnel and a pouring means when matter is added to or poured from the melting chamber 16. The melting chamber 16 and a cooling vessel are constructed to contain the molten lead utilized in the extraction process. The heating cylinder 14 is designed to surround the lower portion of the melting chamber 16 and to contain a sufficient heating means such that the lead within the melting chamber 16 may be maintained in a molten state.

In the embodiment 10, heat is obtained by hydrocarbon combustion. A flammable hydrocarbon, such as propane, is introduced into heating cylinder 14 through a gas intake inlet 20 near the bottom of cylinder 14. The hydrocarbon is then ignited by an igniter mechanism 22, such as an ordinary automotive spark plug. A pilot light or other mechanism may be utilized in lieu of the spark plug 22. The ignited hydrocarbon provides sufficient heat to maintain the lead in a molten state. The exhaust gases from the combusted hydrocarbon exit the heating cylinder via an exhaust outlet 24 situated at the top of the cylinder.

Ore is inserted into the melting chamber 16 by way of an ore tube 26 which extends outward through the heating chamber 14 to cooler areas such that the ore tube 26 may be continually filled with ore while the extractor device 10 is in operation. An auger 28 extends through the center of ore tube 26 and acts to deliver the ore to the lower portion of the melting chamber 16. For increased volume processing additional ore tubes 26 may be included in the device.

Referring now to FIG. 2, a cross-section taken along line 2—2 of FIG. 1, the interior of the extractor device 10 is shown. In this view it may be seen that the heating cylinder 14 and melting chamber 16 are concentric right cylindrical volumes. The manner in which the auger 28 is situated within ore tube 26 delivers ore into melting chamber 16 is also shown. It is to be noted that the entrance of ore tube 26 into melting chamber 16 is very near the bottom of melting chamber 16 such that the ore is introduced at as low a point in the molten lead as possible. This provides for maximum exposure of the ore particles to the molten lead while the ore particles are within the melting chamber 16.

FIG. 3 illustrates an agitator 30 for use with extractor 10. Agitator 30 includes a handling rod 32 by which the agitator 30 may be grasped or manipulated and a plurality of monitor plates 34 situated at the lower end of the handling rod 32. Monitor plates 34 are designed to be irregular in shape so as to provide maximum agitation of the molten mixture when rod 32 is either rotated or moved up and down. Agitator 30 thus provides both translational and rotational agitation to the molten lead mixture and helps provide for maximum exposure of the ore particles to the molten lead and consequently maximum precious metal extraction. Agitator 30 may be either manually or mechanically manipulated to provide mixing.

The various components of the extractor device 10 are constructed of materials which are strong enough to withstand high heat differentials and significant agitation. Preferred materials are cast iron and steel.

Extractor apparatus 10 may be constructed in any desired size. A small model may be sufficient for use in the field for assaying various ore whereas a larger model may be utilized to process greater quantities of that ore.

Although the present invention has been described above in terms of the presently preferred embodiments, it is to be understood that such disclosure is not to be considered as limiting. Accordingly, it is intended that the appended claims be interpreted as covering all alterations and modifications as fall within the true spirit and scope of the invention.

I claim:

1. A process for extracting gold, silver, platinum, lead or manganese metals from ore comprising such metals, in steps comprising:

a. pulverizing an ore material comprising gold, silver, platinum, lead or manganese into fine particles;

b. drying the ore particles thoroughly to remove moisture;

c. melting, in a suitable right cylindrical melting chamber, a preselected amount of elemental lead and maintaining the molten lead within a predetermined temperature range;

d. introducing the dried, pulverized ore into the molten elemental lead at the lower portion of the right cylindrical melting chamber;

e. agitating the molten mixture, both translationally and rotationally throughout the introduction of said ore to the right cylindrical melting chamber and as said ore gradually rises from said lower portion of the right cylindrical melting chamber;

f. pouring the molten mixture into a cooling vessel to cool the mixture and separate the metallic mixture from the slag; and g. removing the slag from the top of the mixture whereby the metallic mixture may then be recovered or refined to separate the various metallic components of gold, silver, platinum, lead or manganese therein.

2. A process according to claim 1 wherein the ore material is pulverized such that the particles may be passed through a separator screen of at least 250 mesh.

3. A process according to claim 1 wherein the ore material is pulverized such that the particles may be passed through a 325 mesh separator screen.

4. A process according to claim 1 wherein the depth of the molten lead within the right cylindrical melting chamber is greater than the width of the right cylindrical melting chamber to facilitate the extraction process as the ore rises from said lower portion of the right cylindrical melting chamber.

5. A process according to claim 1 wherein said predetermined temperature range is between 1200 and 1500 degrees Fahrenheit.

6. A process according to claim 1 wherein the pulverized ore material is gradually inserted into the lower portion of the right cylindrical melting chamber by an auger mechanism housed within an ore tube extending outward from said lower portion of the right cylindrical melting chamber and penetrating at an angle to an outer concentric right cylindrical heating chamber.

7. A process according to claim 1 wherein the molten mixture is agitated for approximately fifteen minutes utilizing a manipulable agitation rod including a plurality of irregularly shaped monitor plates for providing maximum agitation of the molten mixture when said rod is manipulated.

8. A process according to claim 3 wherein the depth of the molten lead within said right cylindrical melting chamber is greater than the width of the right cylindrical melting chamber to facilitate the extraction process as the ore rises from said lower portion of the right cylindrical melting chamber, said predetermined temperature range is between 1200 and 1500 degrees Fahrenheit, the pulverized ore material is gradually inserted into the lower portion of the right cylindrical melting chamber by an auger mechanism housed within an ore tube extending outward from said lower portion of the right cylindrical melting chamber and penetrating at an angle an outer concentric right cylindrical heating chamber, and the molten mixture is agitated for approximately fifteen minutes utilizing a manipulable agitation rod including a plurality of irregularly shaped monitor plates for providing maximum agitation of the molten mixture when said rod is manipulated.

9. A process according to claim 8 wherein said agitation rod is mechanically manipulable.

10. A process according to claim 8 wherein said agitation rod is manually manipulable.

11. A process according to claim 8 wherein said agitation rod is removable from the metal extractor.

12. A process according to claim 1 wherein the pulverized ore material is gradually inserted into the lower portion of said right cylindrical melting chamber by a plunger mechanism housed within an ore tube extending outward from said lower portion of the right cylindrical melting chamber and penetrating at an angle an outer concentric right cylindrical heating chamber.

13. A process according to claim 3 wherein the depth of the molten lead within said right cylindrical melting chamber is greater than the width of the right cylindrical melting chamber to facilitate the extraction process as the ore rises from said lower portion of the right cylindrical melting chamber, said predetermined temperature range is between 1200 and 1500 degrees Fahrenheit, the pulverized ore material is gradually inserted into the lower portion of said right cylindrical melting chamber by a plunger mechanism housed within an ore tube extending outward from said lower portion of the right cylindrical melting chamber and penetrating at an angle in outer concentric right cylindrical heating chamber, and the molten mixture is agitated for approximately fifteen minutes utilizing a manipulable agitation rod including a plurality of irregularly shaped monitor plates for providing maximum agitation of the molten mixture when said rod is manipulated.

14. A process according to claim 13 wherein said agitation rod is mechanically manipulable.

15. A process according to claim 13 wherein said agitation rod is manually manipulable.

16. A process according to claim 13 wherein said agitation rod is removable from the metal extractor.

* * * * *